United States Patent [19]

Knudson

[11] Patent Number: 4,981,060

[45] Date of Patent: Jan. 1, 1991

[54] CUTTING APPARATUS

[76] Inventor: Gary A. Knudson, 17356 W. 57th Ave., Golden, Colo. 80401

[21] Appl. No.: 421,782

[22] Filed: Oct. 16, 1989

Related U.S. Application Data

[62] Division of Ser. No. 240,273, Sep. 6, 1988, Pat. No. 4,899,566.

[51] Int. Cl.[5] ..... B26D 5/16

[52] U.S. Cl. ..... 83/555; 83/573; 83/602; 83/628; 83/638

[58] Field of Search ..... 83/310, 315, 555, 597, 83/602, 605, 628, 638, 573

[56] References Cited

U.S. PATENT DOCUMENTS

| | | | |
|---|---|---|---|
| 510,512 | 12/1893 | Lee | 83/605 |
| 951,636 | 3/1910 | Farrington | 83/555 |
| 1,589,657 | 6/1926 | Pels | 83/555 |
| 1,758,019 | 5/1930 | Williams | 83/555 |

*Primary Examiner*—Douglas D. Watts
*Assistant Examiner*—Scott A. Smith
*Attorney, Agent, or Firm*—Fields, Lewis, Pittenger & Rost

[57] ABSTRACT

A roll forming apparatus disclosed has a series of roll forming stations with a first group of stations having rollers that are adjustable to different width settings using the same rollers to form more than one width of ogee type gutter. A cutter uses interchangeable cutting blades and die plates for shearing different gutter sizes to selected lengths. The cutter uses a rotary drive member to move the blade in a path having a relatively short stroke that performs a scissor-like cutting action to successively cut the walls of the formed gutters for each revolution of the rotary drive member. A crank member for manually moving the cutter blade is collapsible and the crank handle is demountable for transport purposes.

15 Claims, 11 Drawing Sheets

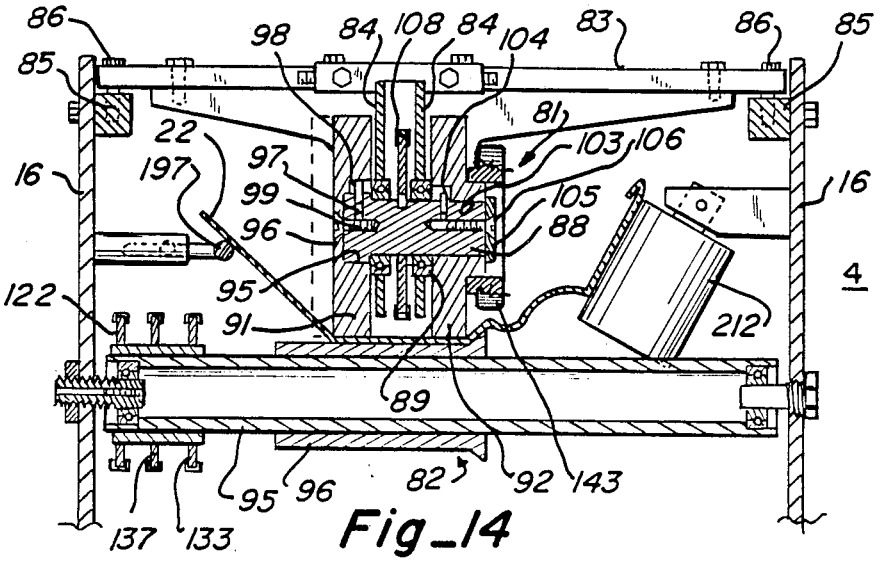
Fig_14
Fig_15
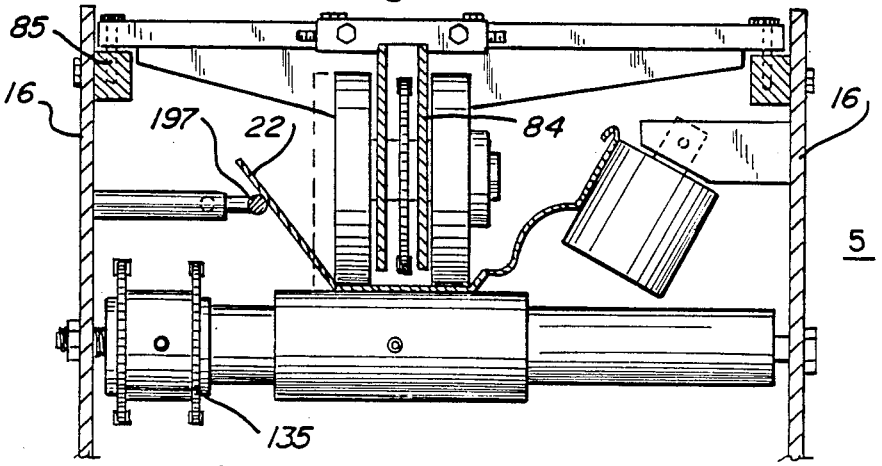
Fig_16
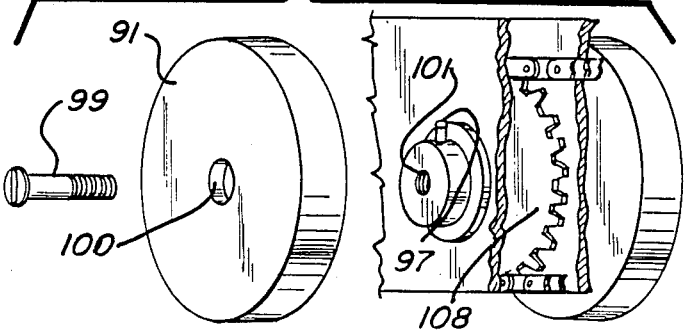
Fig_17
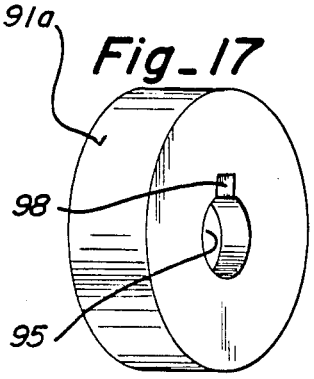

6

7

8

CUTTING APPARATUS

This application is a division of application Ser. No. 240,273, filed Sep. 6, 1988 now U.S. Pat. No. 4,899,566.

TECHNICAL FIELD

This invention relates to apparatus for making shaped members from a sheet material and particularly ogee-type gutters.

BACKGROUND ART

There are a variety of shaped members that are formed from sheet metal coil stock using a plurality of successive forming stations. One example is the seamless ogee-type gutter used on residential and commercial buildings to transfer water from the eave to a downspout. Currently, there is a considerable demand for the five and six inch ogee-type seamless gutters.

In U.S. Pat. No. 3,529,641 there is disclosed a portable roll forming machine for making gutters. This machine is constructed to form a single gutter width. U.S. Pat. No. 3,791,185 discloses a roll-forming machine for forming multiple panel shapes.

DISCLOSURE OF INVENTION

Apparatus is disclosed for making shaped members from sheet material, particularly ogee-type gutters. The apparatus includes a frame in which there is mounted a series of spaced forming stations. A first group of the stations has upper and lower roller assemblies each including a fixed roller portion and an axially movable, adjustable roller portion in which an interfitting pin and guide channel with stops at the ends serve in locating, guiding and setting the final position of the adjustable roller portion to form either a 5 inch or a 6 inch gutter. A second group of the stations has upper and lower roller assemblies with a central shaft support and a shaft carrying first and second rollers on opposite ends with a narrower roller being used to form the 5 inch gutter and interchangeable with a wider roller to form a 6 inch gutter. A drive member between the two rollers transmits power thereto. A cutter or shear at the discharge end cuts the formed gutter to a selected length. The cutter has a cutter blade driven by a rotary drive member. The cutting blade has cutting edges arranged to successively shear the front wall, bottom wall and back wall of the gutter in a scissors-like shearing action as the rotary drive member is rotated about an axis of rotation. A stop mechanism causes the blade to stop after a full cycle until manually released for the next cutting cycle. A crank mechanism for the cutter moves to a retracted position and the crank handle is demountable for transport purposes.

BRIEF DESCRIPTION OF DRAWINGS

FIG. 14 is a sectional view taken along lines 14—14 of FIG. 2 showing station 4;

FIG. 15 is a sectional view taken along line 15—15 of FIG. 2 showing station 5;

FIG. 16 is a perspective view of the upper roller assembly of FIG. 14 with portions broken away and one roller removed;

FIG. 17 is a perspective view of a wider roller for use in the upper roller assembly used for forming the 6 inch gutter;

DETAILED DESCRIPTION

Figure 1:
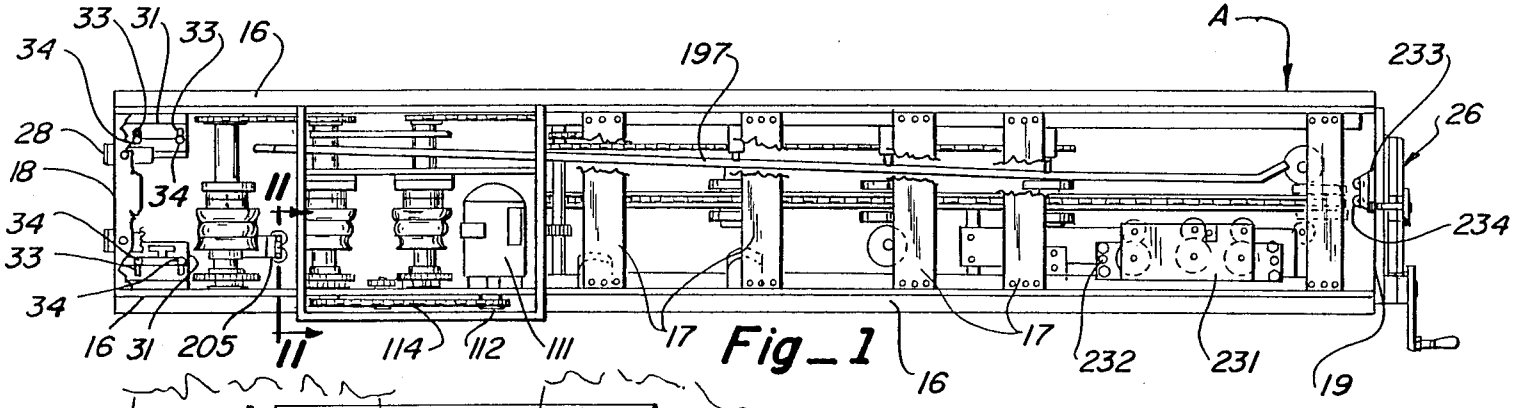
FIG. 1 is a top plan view of apparatus for making gutters embodying features of the present invention.
Figure 2:
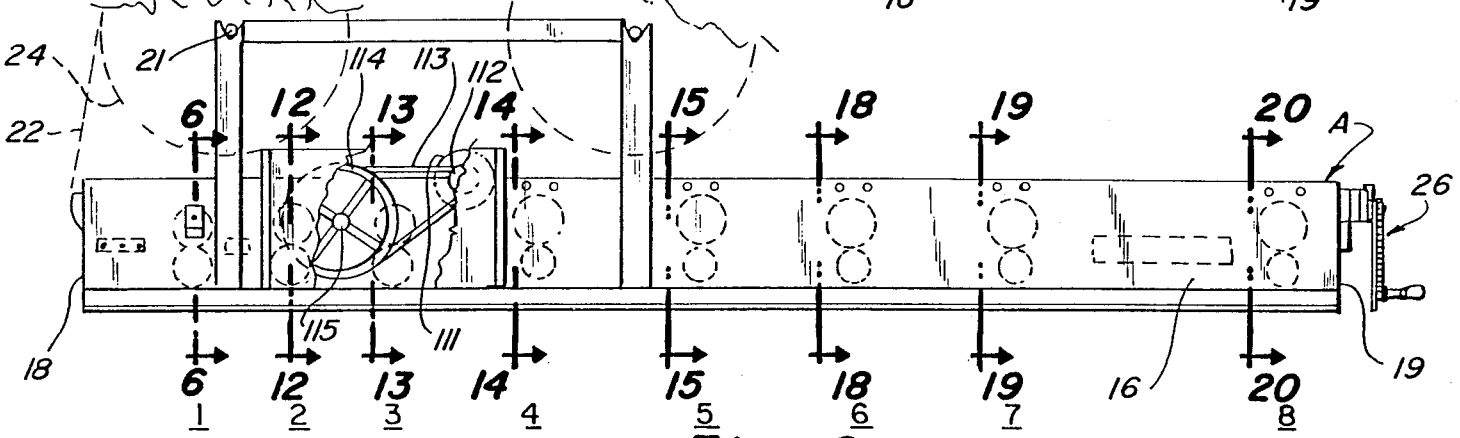
FIG. 2 is a side elevation view of the apparatus shown in FIG. 1.
Figure 3:
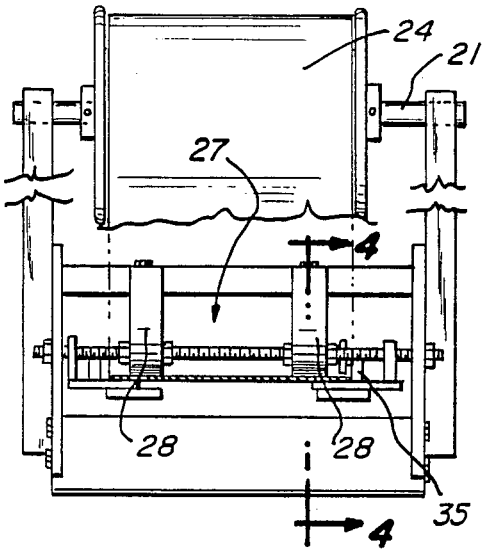
FIG. 3 is an end elevation view of the feed or entry end of the apparatus shown in FIGS. 1 and 2.
Figure 4:
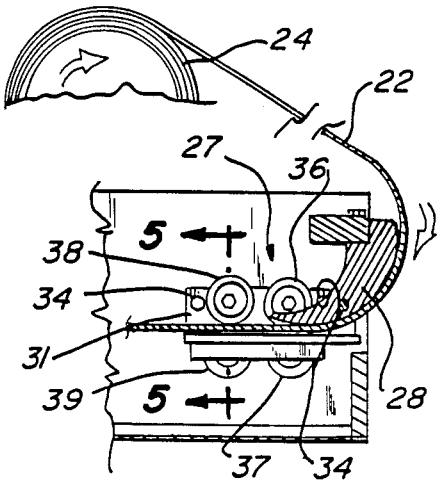
FIG. 4 is a sectional view taken along line 4—4 of FIG. 3.

Referring now to FIGS. 1 and 2, there is shown apparatus for making gutters which includes a generally rectangular support housing or frame A having a base 15, a pair of spaced side plates 16 and a plurality of top cross members 17 connected between the tops of the side plates. A series of eight forming stations designated by numerals 1–8 are provided at selected spaced intervals along and within the frame A between an upstream feed or entry end 18 and a downstream discharge or exit end 19.

A generally flat sheet material 22, preferably sheet metal, enters the apparatus at the feed end 18 and a formed gutter 23 (5 inch) or 23*a* (6 inch) exits the discharge end 19. The sheet material is preferably provided by a large roll of sheet metal coil stock 24 mounted on a shaft 21 rotatably supported on a frame 25 which is continuously fed to and continuously moves through the apparatus. The formed gutter 23 that exits at the discharge end 19 is cut to the desired length by a cutter assembly 26.

Figure 5:
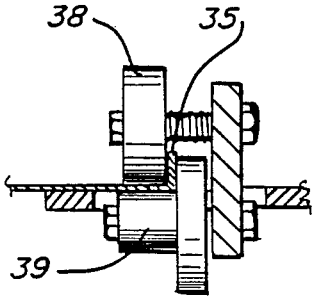
FIG. 5 is a sectional view taken along lines 5—5 of FIG. 4 showing an edge bend portion of the entry guide assembly.
Figure 11:
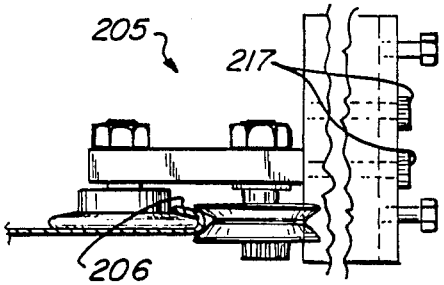
FIG. 11 is a sectional view taken along lines 11—11 of FIG. 1 showing the hembender assembly.

Beginning at the entry end 18, an entry guide assembly 27 includes a pair of spaced top entry guides 28 having a downwardly and forwardly curved surface along which the material 22 from the roll 24 is passed. Each entry guide 28 is mounted to a support body 31 having a pair of parallel spaced slots 33. The support body 31 is arranged to be slid laterally relative to a support base 32. A tightening bolt 34 extends through each slot 33 and into the base 32 so that when the bolt is loosened, each entry guide 28 may be moved toward the outside and secured at an outer position for making the six-inch gutter 23*a*. A first set of top and bottom entry rollers 36 and 37 and a second set of top and bottom rollers 38 and 39 are mounted on a common support which, as seen in FIG. 5, serve as a two-stage former to form a right angle or 90° bend 35 in one side edge of the sheet material. These entry rollers are arranged to slide with the entry guide 28 on the right side to adjust to form either a 5 or 6 inch gutter.

Figure 6:
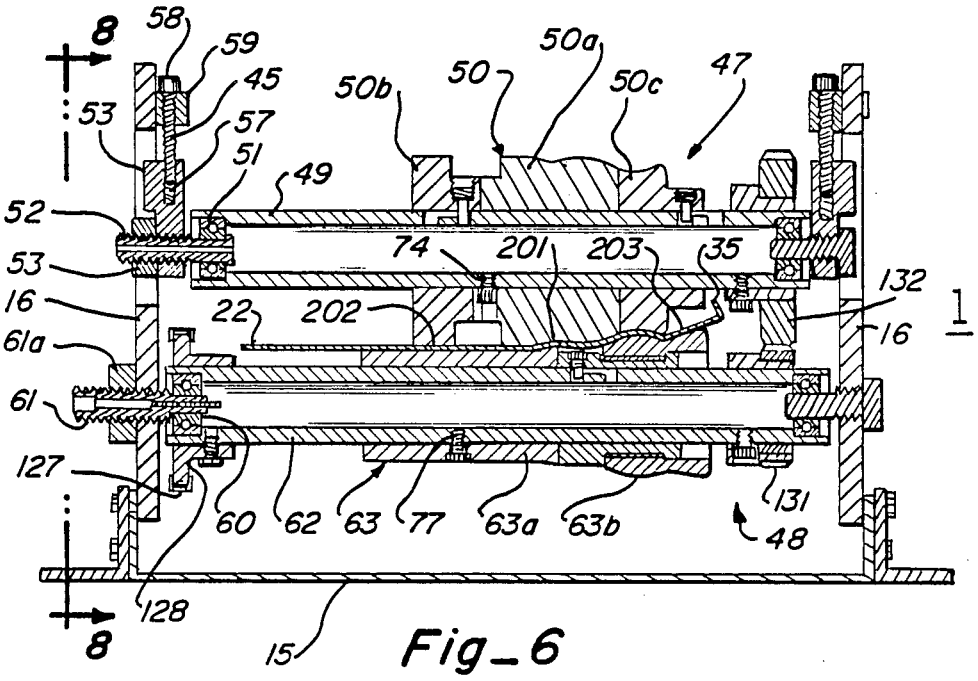
FIG. 6 is a sectional view taken along lines 6—6 of FIG. 2 showing the setting for forming a 5 inch gutter.
Figure 12:
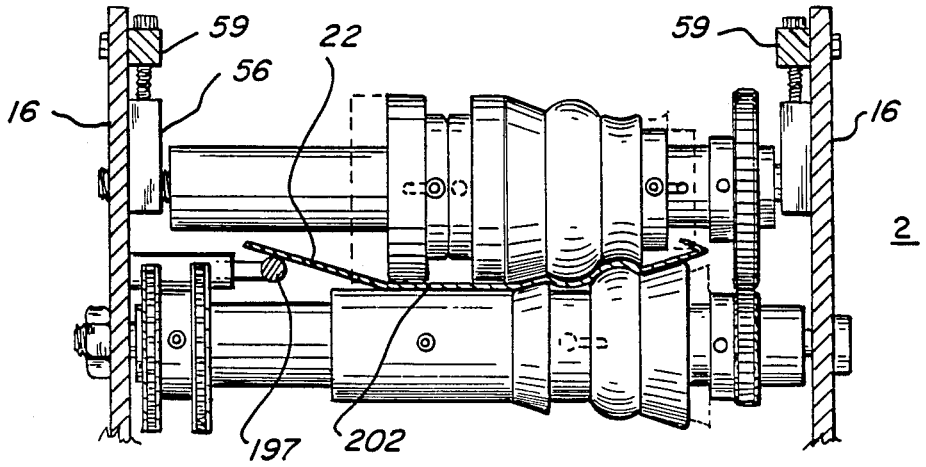
FIG. 12 is a sectional view taken along line 12—12 of FIG. 2 showing station 2.
Figure 13:
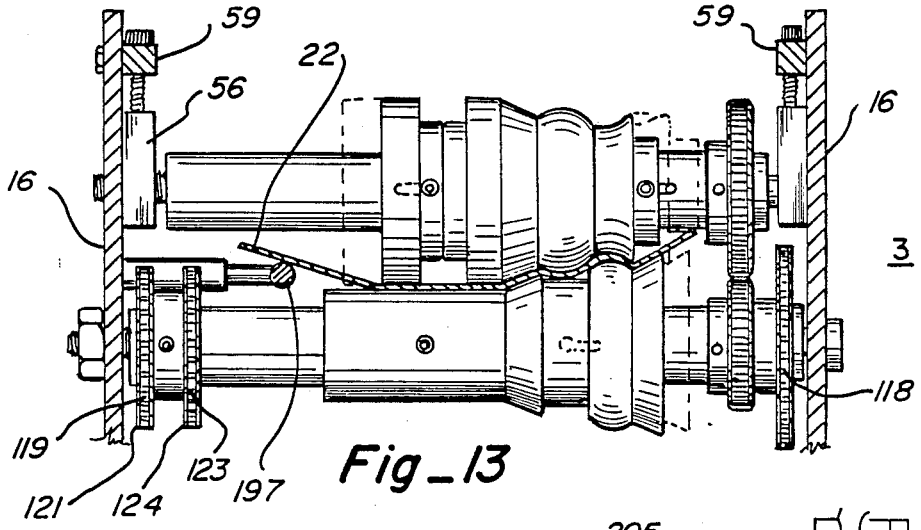
FIG. 13 is a sectional view taken along lines 13—13 of FIG. 2 showing station 3.

The first three forming stations 1, 2, and 3 are of a similar construction so that a description of one generally applies to all. Referring now to FIG. 6 forming station 1 is shown to include a set of upper and lower roller assemblies 47 and 48 between which the sheet metal is passed to be shaped. The upper roller assembly 47 includes a hollow rotary upper shaft 49 on which there is mounted an upper roller 50. The ends of the upper shaft 49 carry a bearing 51 mounted on an externally threaded, hollow shaft 52 supported by a slide block 53 slidable in and guided in a slot 54 in side plate 16 so that each upper roller assembly 47 is vertically adjustably movable relative to the associated lower roller assembly 38 to accommodate sheet materials of different thicknesses. Shaft 52 has external threads and is threaded into slide block 53. A nut 55 in slot 54 threads on the outer end of shaft 52. Block 53 has an internally threaded hole 57 into which is threaded a bolt 58. Bolt 58 threads through block 59 on the inside of side plate 16 and threads into hole 57 so that a threading of the bolt 58 raises or lowers an associated end of the upper shaft 49.

The upper roller 50 includes a fixed roller portion 50*a* that does not move axially or is fixed against movement along the shaft 49 during operation and herein referred to as a fixed roller portion and two adjustable roller portions 50*b* and 50*c* that are slidably movable along the shaft and locked at selected positions and herein referred to as adjustable roller portions.

The lower roller assembly 48 has hollow lower shaft 62 on which there is mounted a lower roller 63 having a fixed roller portion 63*a* and a movable roller portion 63*b*. The lower shaft like the upper shaft has a bearing 60 at each end, an externally threaded shaft 61 like shaft 52 above described that extends through the side plate and has a nut 61*a* threaded on the shaft outside the side plate.

An adjustment means for each adjustable roller portion for the first three roller stations is provided to control the position and guide the movement of each associated adjustable roller portion to locate, guide during movement, and lock each adjustable roller portion at either of two positions for forming either a 5 inch or a 6 inch gutter. Referring now to FIGS. 6–16 the adjustment means for the adjustable roller portion 50*b* includes a pin portion 64 slidable in a channel 65 formed in and extending lengthwise of the shaft 49. Two holes 66 and 67 are formed in the shaft in spaced relation to one another at the ends of the channel. The pin portion 64 is extended radially inwardly from a retracted position to a locked position to lock the associated movable roller portion to shaft 49. The wall surfaces defining holes 66 and 67 form stop surfaces 68 and 69, respectively, at the ends of the channel. The pin portion 64 shown is provided by a set screw having an externally threaded head portion 71 that threads into an internally threaded hole 72 in the roller portion 50*b*.

Figure 9:
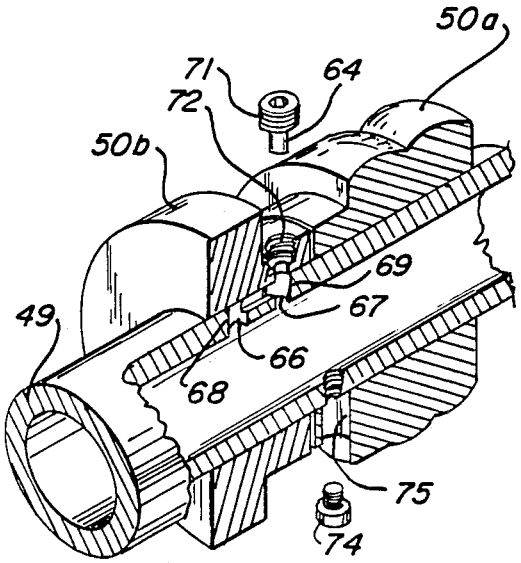
FIG. 9 is a sectional perspective view of the upper roller shown in FIG. 6 with bolts shown in removed positions.
Figure 10:
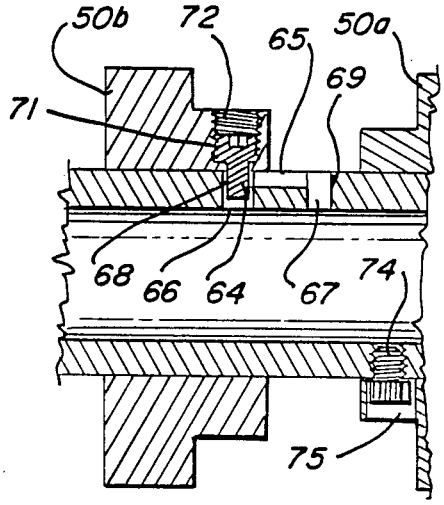
FIG. 10 is a side elevational view of a portion of the upper roller shown in FIG. 9 with the bolts in place.
Figure 18:
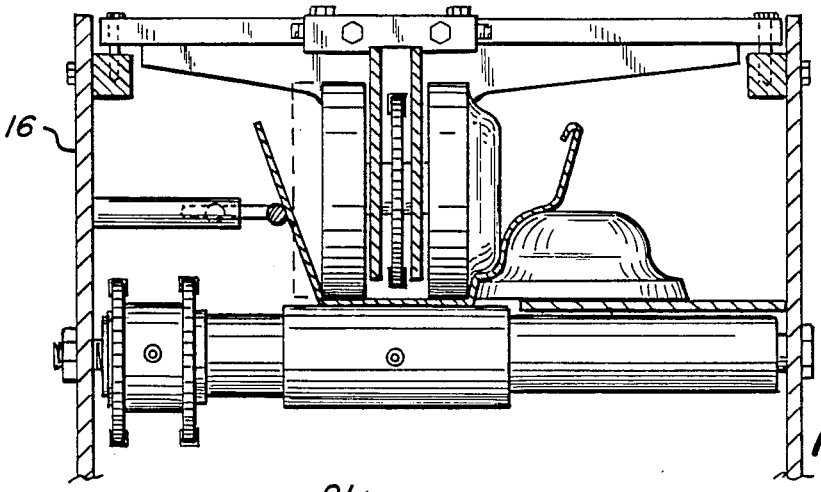
FIG. 18 is a sectional view taken along line 18—18 of FIG. 2 showing station 6.
Figure 19:
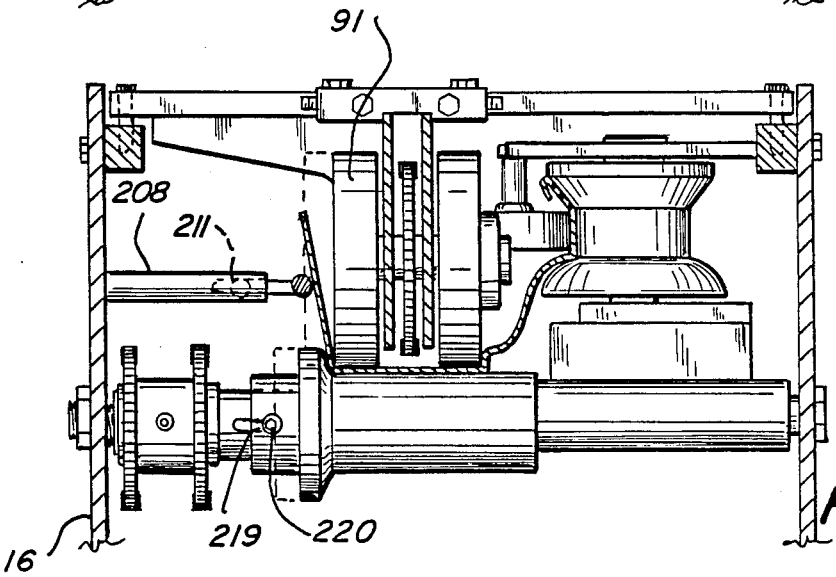
FIG. 19 is a sectional view taken along line 19—19 of FIG. 2 showing station 7.
Figure 20:
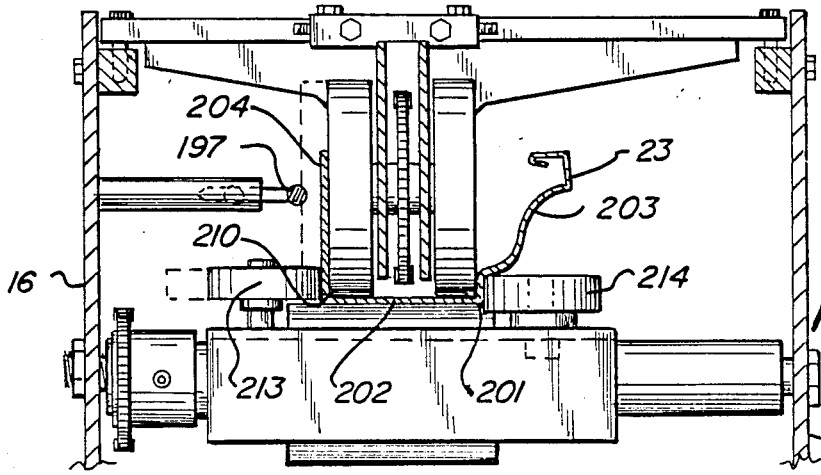
FIG. 20 is a sectional view taken along line 20—20 of FIG. 2 showing station 8.
Figure 24:
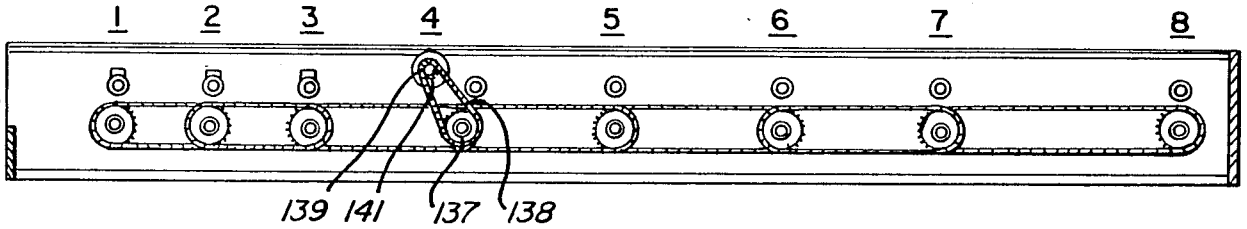
FIG. 24 is a sectional view taken along line 24—24 of FIG. 21.
Figure 23:
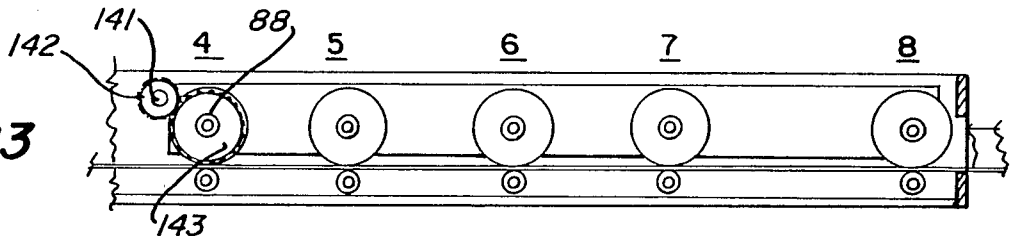
FIG. 23 is a sectional view taken along line 23—23 of FIG. 21.
Figure 22:
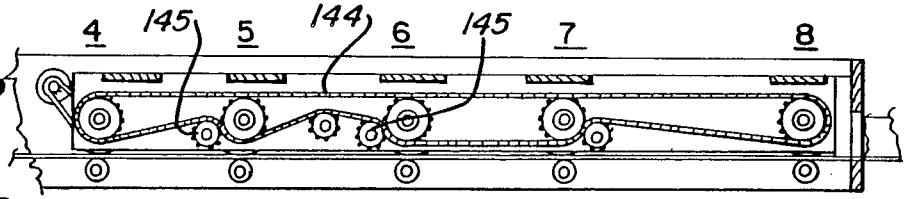
FIG. 22 is a sectional view taken along line 22—22 of FIG. 21.
Figure 21:
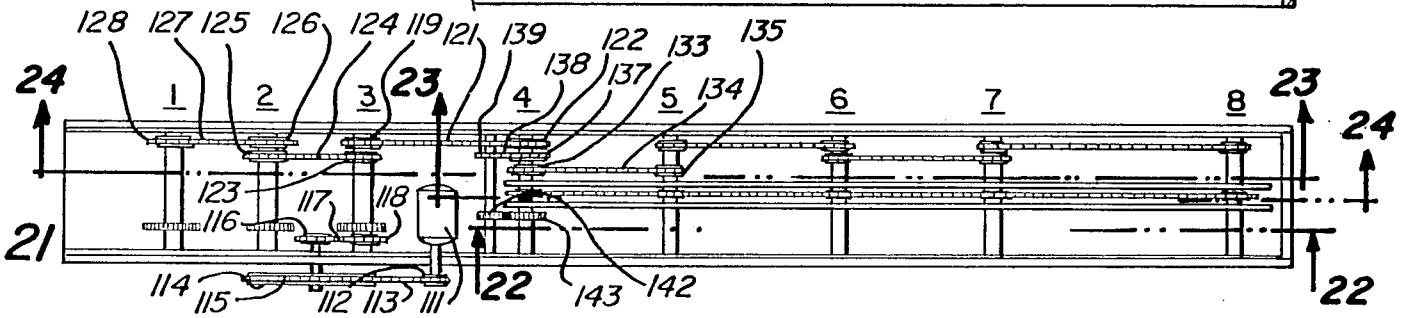
FIG. 21 is a top plan view showing the drive for the rollers of the apparatus of FIGS. 1-20.
Figure 25:
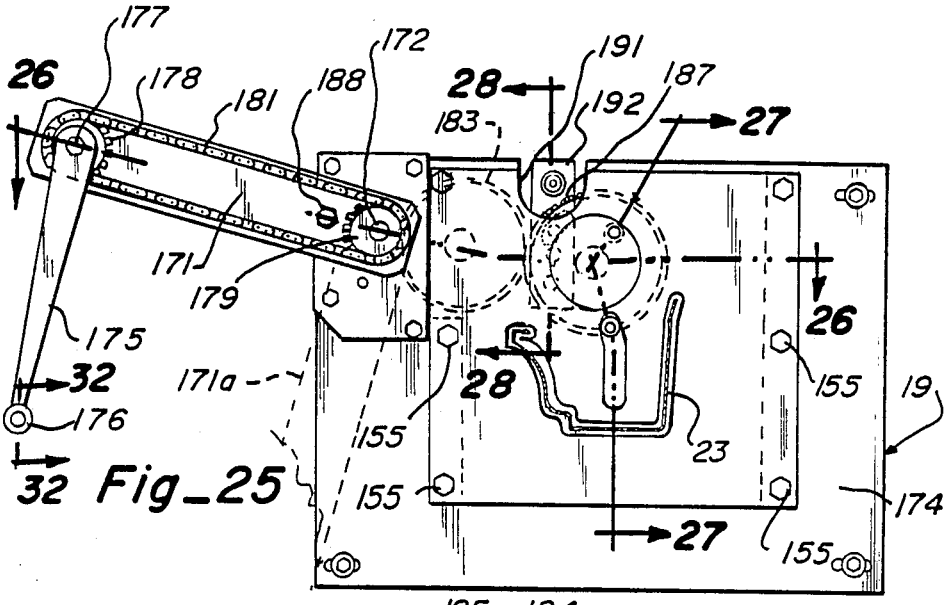
FIG. 25 is an end elevational view of the exit end of the apparatus shown in FIG. 1 with the retracted position for the crank arm shown in dashed lines.
Figure 26:
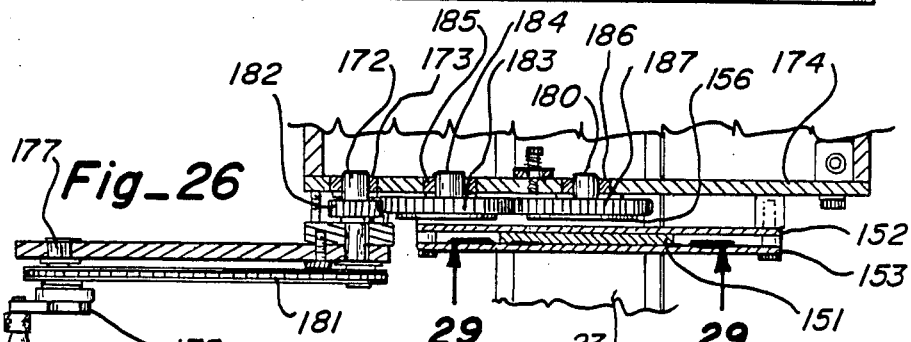
FIG. 26 is a sectional view taken along line 27—27 of FIG. 25.
Figure 27:
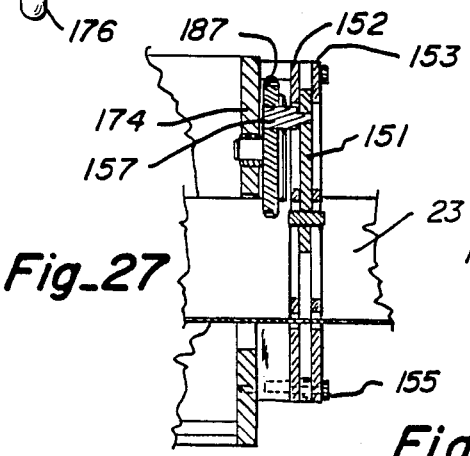
FIG. 27 is a sectional view taken along line 28—28 of FIG. 25.
Figure 28:
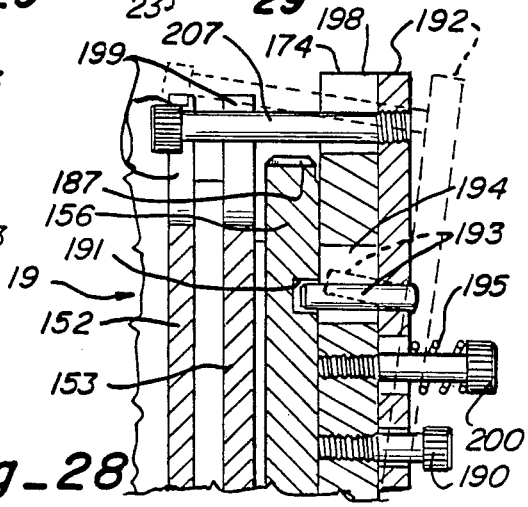
FIG. 28 is a sectional view taken along lines 28—28 of FIG. 25 showing the blade stop arrangement.

The fixed roller portion 50*a* is shown to be rigidly secured to shaft 39 by means of an allen cap screw 74 having a head countersunk into a hole 75 in the fixed roller portion 50*a* and threaded into an internally threaded hole 76 in the shaft 49 as best seen in FIGS. 6, 9 and 10. The fixed roller portion 63*a* is shown rigidly secured to shaft 62 by a screw 77.

Forming stations 4–8 have a generally similar construction. Referring now to FIG. 14, forming station 4 is shown to include a set of upper and lower roller assemblies 81 and 82. The upper roller assembly 81 has a top cross bar 83 and a pair of laterally spaced, parallel support plates 84 connected at top edges to the top cross bar 61 and depending downwardly therefrom. The ends of the cross bar 83 are supported to be adjusted up and down to change the spacing or gap between the upper and lower rollers by means of a support block 85 with an internally threaded hole into which an adjustment bolt 86 extending through bar 83 threads. An upper shaft 88 is supported for rotary movement on a bearing 89 in each of plates 84.

A first upper roller 91 and a second upper roller 92 are mounted on opposite ends of the shaft 88 for conjoint rotation therewith. The first upper roller 91 is formed with a central blind bore 95 in a central end wall portion 96 into which one end of the shaft 88 extends. The end of the shaft carries a pin 97 that fits in a radial slot 98 in the roller 91 so as to prevent relative rotation between the two to transmit the rotation of the shaft to roller 91 and also prevents slippage while allowing ready removal and replacement. A bolt fastener 99 extends through a central hole 100 in the end wall portion 96 and threads into an internally threaded hole 101 the end of upper roller to further secure the roller 91 to the shaft and provide for a ready removal and replacement or the interchangeability of roller 91 with a wider roller 91*a* shown in FIG. 17 for forming the 6 inch gutter 23*a*.

The second upper roller 92 has a central axial through bore 103 through which the other end of shaft 88 extends. A pin 104 in shaft 103 extends into a slot in shaft 88 to transmit rotary movement to the roller 92 and prevents relative slippage. An end cap 105 has a bolt fastener 106 extending into the end of the shaft to releasably fasten the second roller 92 to the end of the shaft. A centrally disposed chain sprocket 108 is mounted on an intermediate portion of the shaft 88 through which power is transmitted to rotate the upper roller assembly.

This central mount skate type arrangement for the upper rollers keeps the diameter of the forming roller down (low profile) whereas the prior art having the rollers supported along the sides requires a much larger roller to roll form within a channel-shaped gutter. The rollers mounted on the shaft roll true to the surface they are rolling on because the clearance is away from the pressure side of the roller.

The lower roller assembly 82 includes a hollow lower shaft 95 rotatably mounted like lower shaft 62 previously described using a bearing at each end, and an externally threaded shaft and an external nut on which there is mounted a fixed lower roller 96. The lower roller assembly at station 7 is shown to include a slot 219 and a bolt fastener 220 which permits the roller to be slid laterally as shown in dashed lines to accommodate forming the wider gutter.

The lower roller at station 8 preferably is of a greater diameter than the lower rollers at stations 4, 5, 6 and 7 since there is more pressure at the exit end. Typical diameters would be 4.5 inches at station 8 and 3 inches at the other stations.

For driving all of the roller assemblies at stations 1–8 and referring to FIGS. 1, 2 and 21–23, beginning at the source of power there is provided an electric motor 111 having an output shaft with a pulley 112, a cog belt 113 trained on the pulley 112 and a larger pulley 114 on the end of a jackshaft 115. The other end of the jackshaft 115 has a chain sprocket 116. A chain 117 is trained on the sprocket 116 and a chain sprocket 118 on the lower roller shaft of the third station 3. Another chain sprocket 119 on this lower roller shaft has a chain 121 trained thereon which is also trained on a chain sprocket 122 on the lower roller shaft 95 of station 4. Another chain sprocket 123 on the lower shaft of station 3 has a chain 124 trained on a chain sprocket 125 on the lower shaft of station 2. A chain sprocket 126 on the lower roller shaft of station 2 has a chain 127 on sprocket 96 and chain sprocket 128 on the lower roller shaft of station 1.

As seen in FIG. 1 the lower roller shaft at station 1 has a gear 131 that meshes with a gear 132 on the upper roller shaft at station 1 to transmit power from the lower roller shaft to the upper roller shaft. Stations 2 and 3 have similar drive arrangements between associated lower and upper roller shafts.

A chain sprocket 133 on the lower roller shaft of station 4 has a chain 134 trained on sprocket 133 and a sprocket 135 on the lower shaft of station 5. A chain sprocket 137 on the lower roller shaft of station 4 carries a chain 138 trained on a sprocket 139 on a jackshaft 141 above the lower shaft. This jackshaft 141 carries a gear 142 that meshes with a gear 143 on the shaft 88 of the first skate section at station 4. A chain 144 is trained on the central sprockets of stations 5, 6, 7, and 8 using chain takeup rollers 145 to rotate the central sprockets simultaneously.

The cutter or cutting assembly 26 shown for cutting the 5 inch gutter includes a movable cutting or shearing blade 151 (five inch) between a pair of die plates 152 and 153 removably mounted to the end of the frame by four bolts 155. Each of the die plates has an opening 154 corresponding to an enlarged shape of the formed gutter. The cutting blade 151 is reciprocated between an upper retracted position and a lower extended position through a preselected path by a drive means which includes a rotary drive member 156 with a drive pin 157 mounted a fixed distance from the axis of rotation of member 156. A cam 158 on the blade 151 movable in a slot 159 in each die plate is arranged to guide the blade in a selected path. The cam 158 preferably is a pin with a cam follower on the end of a supporting pin that rotates relative to the supporting pin. In sequence, the blade 151 cuts the front wall, the bottom wall, and then the other back wall of the gutter in a continuous shearing action for each revolution of the rotary drive member 156.

Figure 29A:
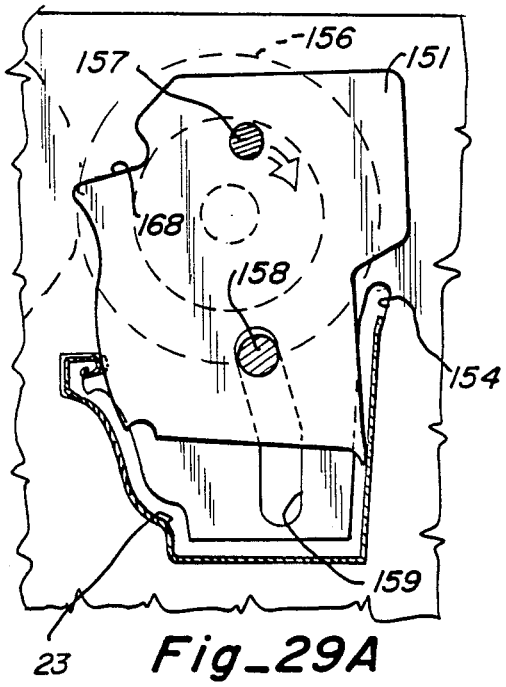
FIGS. 29A, 29B, 29C, and 29D are sectional lines taken along line 29—29 of FIG. 26 showing different cutting positions for the shear blade.
Figure 29B:
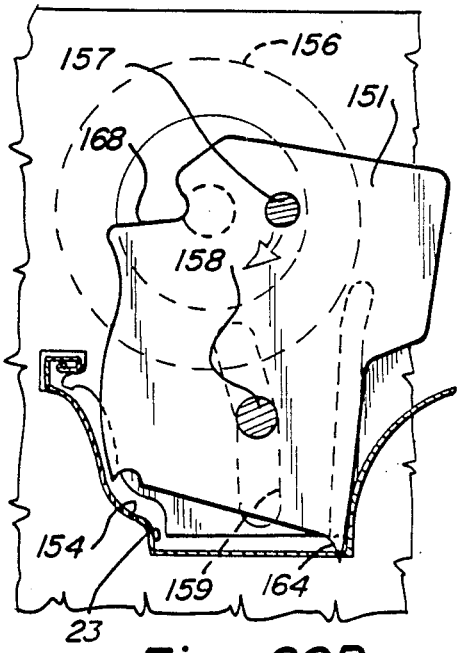
Figure 29C:
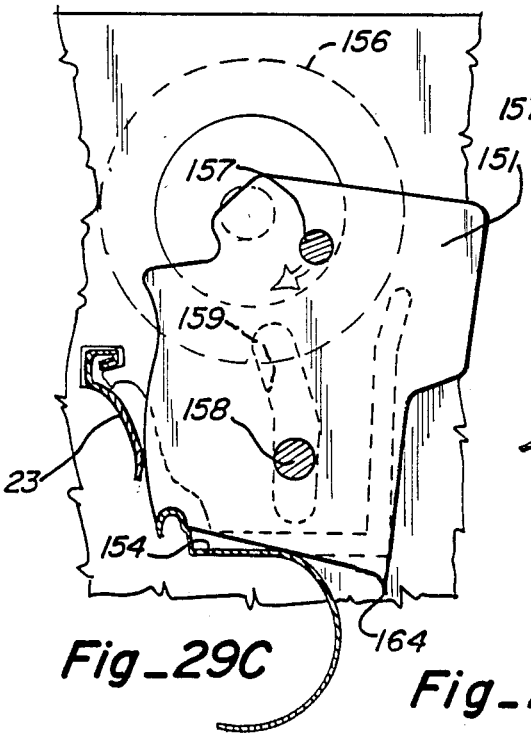
Figure 29D:
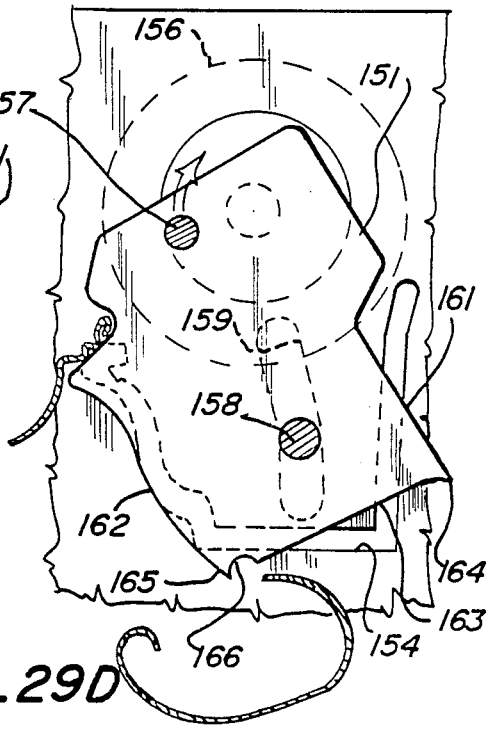
Figure 30:
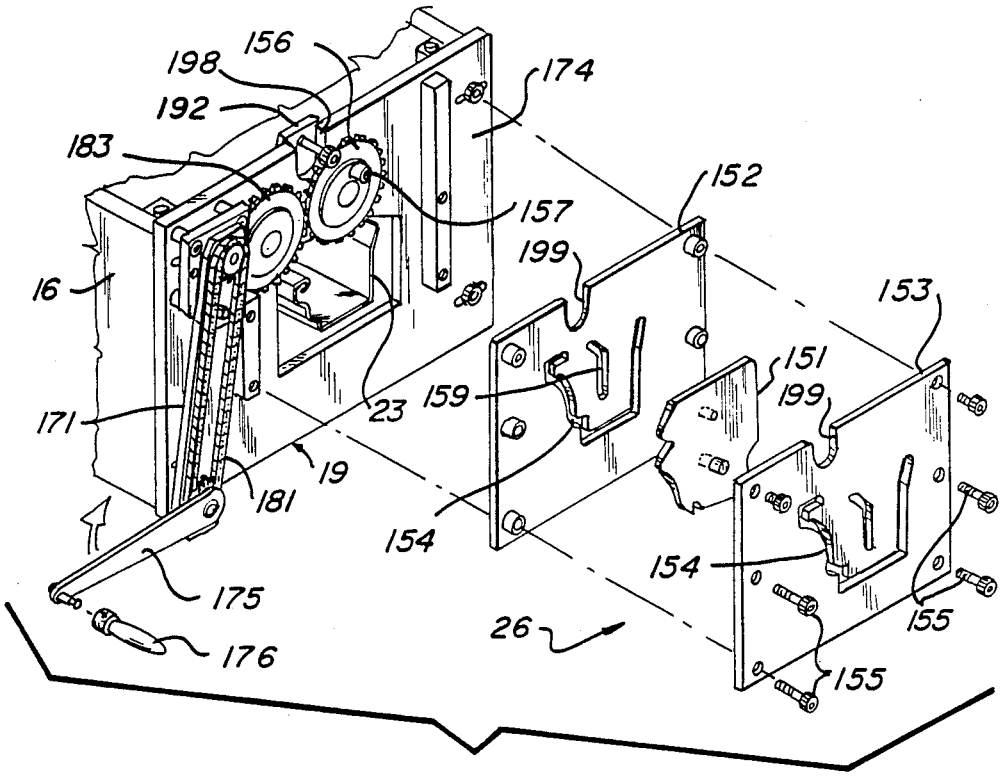
FIG. 30 is an exploded perspective view of the apparatus shown in FIGS. 25-28.
Figure 31:
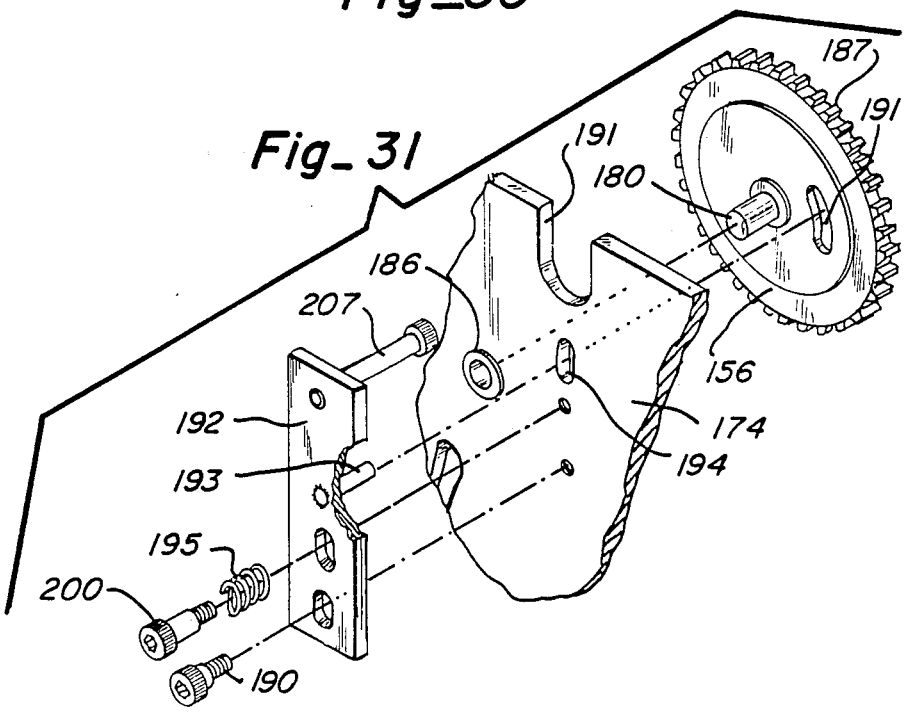
FIG. 31 is an exploded view of a portion of the blade stop arrangement shown in FIGS. 28 and 30.

As viewed from the downstream end 19, the cutting blade 151 has opposed front and rear side edges 161 and 162 and a bottom edge 163 sized and shaped to extend down into the gutter 23. A downwardly protruding claw or tooth 164 is formed at the corner between the front and bottom edges to pierce the front bottom corner of the gutter. A downwardly pointing claw or tooth 165 is provided at the corner of the rear side edge and bottom edge is formed by providing a circular recess 166 in the bottom edge and the lower portion of the rear side edge is formed along a reversed S curve which serves to pierce the other rear bottom corner of the gutter. The upper portion of the rear side edge has an inwardly extending ledge portion 168 that serves to cut the gutter hem as seen in FIG. 29D.

This cutter or shear arrangement above described gets away from the use of a relatively long lever. The tilt of the blade relative to the wall being cut provides for an optimum shear angle rather than moving directly perpendicular to the surface being cut which is relatively inefficient and can result in flare, rough edges and sticking points. The motion imported to the blade provides a continuous cutting motion and a scissors like cutting action also avoiding the cutting of too much material at one time.

A manually operable cranking mechanism for moving the cutting blade 151 includes an extension arm 171 mounted at one end on a shaft 172 that extends into a bearing 173 in a downstream end wall 174 of frame A. A crank arm 175 with a handle 176 is mounted on a shaft 177 at the free end of the extension arm 171. The drive train between shaft 177 and the rotary drive member 156 includes a sprocket 178 on the shaft 177 and a sprocket 179 on shaft 172 with a chain 181 trained on sprockets 178 and 179. A smaller gear 182 on the shaft 172 meshes with a larger gear 183 mounted on a shaft 184 in a bearing 185 on the end wall 174. This larger gear 183 then meshes with a gear 187 of the same diameter on the rotary drive member 156. Rotary drive member 156 is mounted on a shaft 180 in a bearing 186 in end wall 174. The gear ratio of gears 182 and 183 is such that the rotation of the crank arm 175 three revolutions rotates the rotary drive member 156 one revolution. In the operative position, the extension arm 171 extends out and up and is held in place by a removable pin 188 which extends through holes in the arm 171 and the end wall 174. When not in use, the pin 188 is removed and the extension arm 171 will pivot down to a lower position or retracted position as shown in dashed lines 171a so as to be out of the way during transport.

The cranking mechanism is provided with a stop arrangement that causes the blade 151 to stop after a complete cycle of operation leaving the dies ready to pass the next length of gutter. This is accomplished by providing an arcuate slot 191 extending through an arc of about 60° of the entire arc of 360° thereof in the downstream face of the rotary drive member 156. A lever arm 192 is secured at the lower end to end wall 174 by bolt 190 to enable lever arm 192 to pivot at the lower end. Lever arm 192 is spring-biased by a spring 195 held by bolt 200. A pin 193 that extends through a hole 194 in end plate 174 and when pin 193 is in slot 191 lever arm 194 is biased by spring 195 flat against end plate 174. During the rotation of the crank and thereby rotary member 156 the pin 192 rides on a downstream face of the rotary member and toward the end of the cycle the pin 193 is urged by the bias spring 195 into the slot 191. Once the pin 193 comes to and engages the end wall of the slot further rotation of member 156 is prevented. In this position the crank handle is down and the cutter blade is out of the way and is ready to receive the gutter. For the next cut rod 197 is pushed by the operator while starting to turn the crank. A rod 207 affixed to the upper end of the lever arm 192 is moved by the operator to pull the pin 193 from slot 191 and enable the crank arm 175 and handle 176 to be turned for the next cutting operation. Rod 207 is shown to extend through slots 198 and 199 in plates 174, 152 and 153 respectively.

Figure 33:
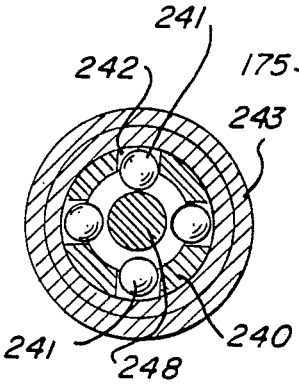
FIG. 33 is a sectional view taken along line 33—33 of FIG. 32.
Figure 32:
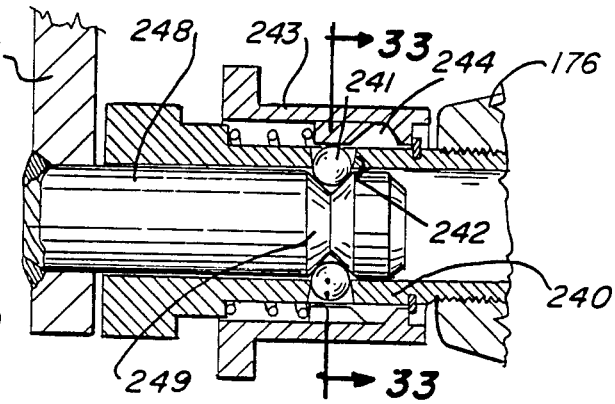
FIG. 32 is a sectional view through the crank handle when in a cranking position.
Figure 34:
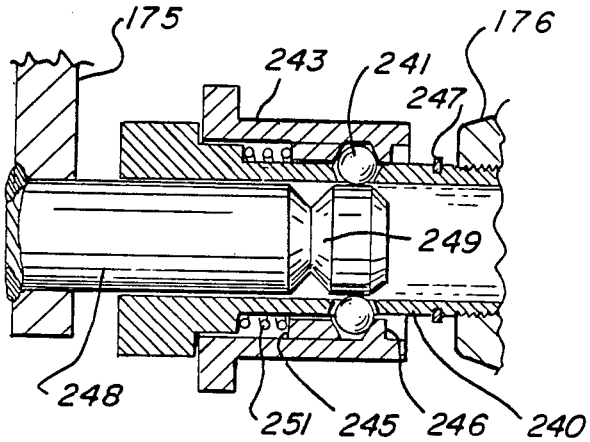
FIG. 34 is a sectional view through the crank handle when in a partially removed position.

The crank handle 176 is demountable from the crank arm 175 by means of a snap-fit socket arrangement shown in FIGS. 32–34. The crank handle 176 has a hollow shaft extension 240 threadably connected thereto that carries four ball bearings 241 in circumferentially spaced openings 242 therein. A collar 243 telescopes over shaft extension 240 and is slidable axially relative thereto. The collar 243 has an inside peripheral groove 244 with inside end walls 245 and 246. In the assembled position end wall 246 engages a snap ring 247 to limit the movement of the collar toward handle 176. The crank arm 175 has a stub shaft 248 with a V-groove 249 adjacent the free end. The stub shaft slidably fits and telescopes in the hollow shaft extension 240 and when fully inserted into the hollow shaft the ball bearings are urged by the inside of the collar 243 into the V-groove (FIGS. 32, 33). When the collar 243 is slid axially away from 176 the ball bearings are urged out of the groove and release the crank handle from the crank arm. A spring 251 is a bias between members 243 and 240.

Figure 7:
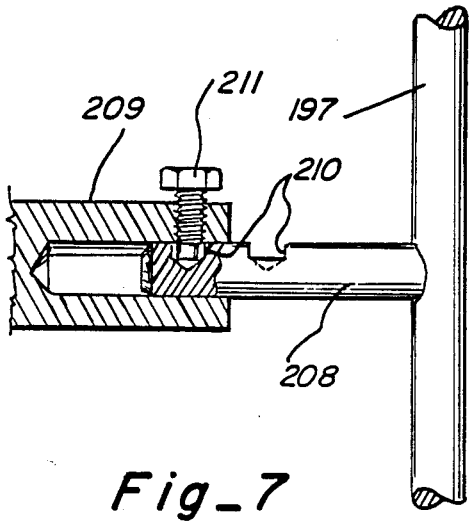
FIG. 7 is an enlarged view of the guide rail.
Figure 8:
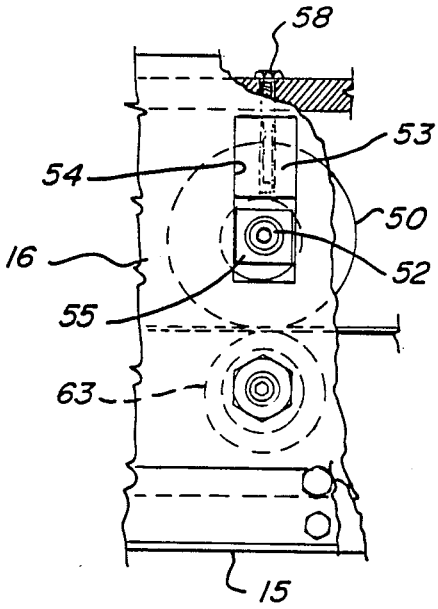
FIG. 8 is a fragmentary side elevational view taken along line 8—8 of FIG. 6.

The forming of the gutter 23 is accomplished at the forming stations 1–8 with each successive pass of the sheet material 22 between sets of upper and lower roller assemblies at stations 1–8 bringing the partially formed panel closer to the final shape. The entry guide assembly 27 turns the edge of the sheet to form a right angle bend 35. As shown in FIG. 6 at station 1, the lower roller forms corner 201 between the bottom wall 202 and the front wall 203 and begins the formation of the ogee in the front wall 203. Subsequent to station 1, the hembender assembly 205 turns the edge portion back on itself to form the hem 206. At stations 2 and 3, the guide rail 197 turns the opposite back wall 204 gradually toward the upright position while the ogee sidewall is further formed and also turned toward the upright position. As shown in FIG. 7, the guide rail 197 has a length of rod 208 secured at right angles thereto that slides in a stationary support socket 209. Rod 208 is held by a turn knob 211 that extends into one of two notches 210 in rod 208 to adjust to form either the 5 inch or the 6 inch gutter.

Referring now to station 4, the guide rail 197 further turns the sidewall up and an auxiliary roller 212 disposed at a selected angle to the horizontal turns the front wall 203 up and in. At stations 5 and 7 the front wall is progressively turned toward a right angle position by the guide rail 197 and finally at station 8 rollers 213 and 214 on each side and rotatable about a vertical axis form the right angle corners 201 and 210 in the gutter.

Figure 35:
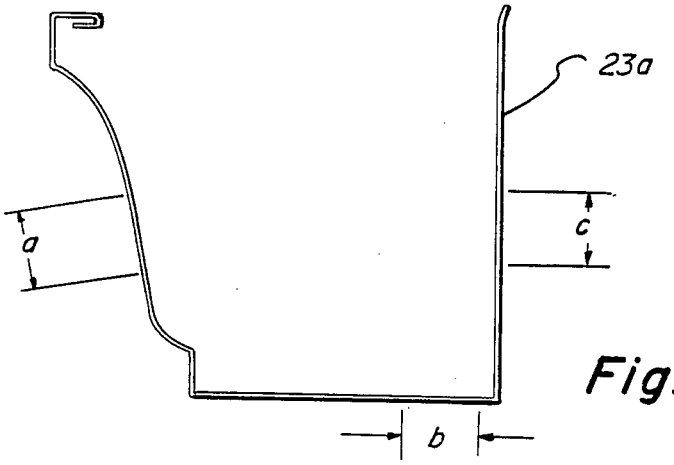
FIG. 35 is a sectional view showing a six inch gutter and the added dimensions in relation to the five inch gutter.

Referring now to FIG. 35 it is seen that the six inch gutter is formed from a wider strip of sheet metal (typically 1½ inches wider) than that of the five inch gutter and differs from the five inch gutter by having an added length or section "b" in the bottom wall wider than the five inch gutter as established by the wider roller (FIG. 17) and by having an added length or section "a" in the front ogee wall. The rear wall has an added length or section "c" from that of the five inch gutter. Thus the same shaping rollers are used to form both gutters.

In order to change the apparatus from making five inch gutters 23 to making six inch gutters 23a, the entry guides 28 are adjusted by loosening four bolts 34 on the top side and sliding the vertical guides laterally outwardly to the outside of the apparatus and retightening the bolts 34. At stations 1, 2, and 3, the roller locating pins 64 of each adjustable roller portion are loosened at each roller station and the adjustable roller portions are moved laterally outwards to the outside of the apparatus and the locating pins 64 are retightened. For the hembender assembly 205, two bolts 217 are removed on the right side and another hembender assembly 205 arranged for a six inch gutter 23a is inserted and put in place. Locating knobs 211 for the guide rail 197 are loosened and the guide rail 197 is slid all the way to the left side. At roller station 7 locating screws 219 are loosened and the roller is slid to the far left. At roller station 8 a bolt on the top side of the roller is removed and the roller is removed. The roller is aligned to an additional hole after the skate rollers are in place. At the skate roller stations 4–8, the bolt 99 at each station is removed and rollers from the left side are replaced with six inch rollers using the same bolts to hold the six inch roller. The box assembly 231 is adjusted by removing a center bolt 232 on each side of the box and removing the box assembly 231 and replacing with a six-inch box assembly. The crimper assembly 233 is removed by removing two crimper hold down bolts 234 and moving the crimper to upper holes in supporting face plates and tightening the crimper assembly into place. The cutting assembly 26 is changed by removing four shear locating bolts 155, removing the shear blade 151, and die plates 152 and 153 and replacing the five-inch shear blade with a six inch shear blade and six inch die plates and using the same bolts 155 to secure the six inch shear blade in place between the six inch die plates.

Although the present invention has been described with a certain degree of particularity, it is understood that the present disclosure has been made by way of example and that changes in details of structure may be made without departing from the spirit thereof.

What is claimed is:

1. A cutter for cutting shaped members having a plurality of walls to a selected length, said cutter comprising:

a cutting blade with a cutting edge disposed between a pair of die plates, each of said die plates having an opening through which the shaped member is passed, said blade being movable along a selected cutting path between retracted and extended positions, and drive means to move said cutting blade in a selected path, said drive means, including a rotary drive member with a drive pin mounted on said cutting blade a fixed distance from an axis of rotation of said rotary drive member, and guide means to position said blade in said selected path to dispose said cutting edge at a selected angle relative to each wall of a shaped member being cut and through each said wall to successively cut said walls in a shearing action, wherein said guide means includes a cam on said blade movable in slots in said die plates.

2. A cutter as set forth in claim 1 wherein said cutting blade has first, second and third cutting edge portions arranged in the same generally-shaped configuration as the inside of the shaped member being cut.

3. A cutter as set forth in claim 2 including a first claw portion between said first and second cutting edge portions to pierce an inside corner between a front and bottom wall of the shaped member and a second claw portion between said second and third cutting edge portions to pierce a rear wall of the shaped member.

4. A cutter as set forth in claim 2 including a ledge portion at the upper end of said third cutting edge to cut a hem along an upper edge of the shaped member.

5. A cutter as set forth in claim 1 wherein said drive pin extends into a hole in an upper portion of said blade so the upper portion of said blade moves in a circular path as said rotary drive member is rotated about said axis.

6. A cutter as set forth in claim 1 wherein said cam is in a lower portion of said blade so the lower portion of said blade tilts to dispose said cutting edge at a selected angle with respect to each wall of the shaped member during cutting.

7. A cutter as set forth in claim 1 wherein said opening in each die plate corresponds to and are enlarged with respect to that of the shaped member.

8. A cutter as set forth in claim 1 wherein said drive means is moved by a manually operated crank handle assembly including a crank arm and crank handle.

9. A cutter as set forth in claim 8 wherein said crank handle is demountable from said crank arm by means of a snap-fit coupling for transport purposes.

10. A cutter as set forth in claim 8 wherein said drive means includes a gear train between said crank handle and said rotary drive member whereby upon the rotation of said crank handle said rotary drive member is rotated.

11. A cutter as set forth in claim 8 wherein said crank arm is movable between an operable position and a retracted position for transport.

12. A cutter as set forth in claim 11 wherein the drive train has a gear ratio such that three rotations of the crank produces a full revolution for said rotary drive member which is a full cycle of movement for said cutting blade.

13. A cutter as set forth in claim 1 including means to stop said rotary drive member after a full cycle of operation of said cutting blade.

14. A cutter as set forth in claim 13 wherein said means to stop includes an arcuate slot in said rotary drive member and a pin arranged to slide against said rotary member and move into said slot.

15. A cutter as set forth in claim 14 including an actuator arranged to move said pin from said slot to enable the turning of said rotary drive member.

* * * * *